United States Patent [19]

Williams

[11] Patent Number: 4,492,378

[45] Date of Patent: Jan. 8, 1985

[54] GAME APPARATUS

[75] Inventor: Daniel W. Williams, Atlantic City, N.J.

[73] Assignee: Robert McCurdy, Atlantic City, N.J.

[21] Appl. No.: 346,361

[22] Filed: Feb. 5, 1982

Related U.S. Application Data

[60] Division of Ser. No. 184,874, Sep. 17, 1980, abandoned, which is a continuation-in-part of Ser. No. 39,555, May 16, 1979, abandoned.

[51] Int. Cl.[3] ..... A63F 5/04

[52] U.S. Cl. ..... 273/142 HA; 273/142 JA; 273/274

[58] Field of Search ..... 273/142 H, 142 HA, 142 R, 273/142 A, 142 B, 142 C, 142 D, 142 E, 142 F, 142 G, 142 J, 142 JA, 142 JB, 142 JC, 142 JD, 142 K, 141 R, 141 A, 274, 276; D21/22, 25, 26, 39, 40

[56] References Cited

U.S. PATENT DOCUMENTS

| | | | |
|---|---|---|---|
| D. 90,553 | 8/1933 | Schwartz | D21/26 |
| 1,445,891 | 2/1923 | Johnson | 273/141 R |
| 1,578,412 | 3/1926 | Ewig | 273/142 E |
| 1,670,692 | 5/1928 | Rosar | 273/142 F |
| 1,702,246 | 2/1929 | Blattner | D21/22 X |
| 2,077,124 | 4/1937 | Miller et al. | D21/39 X |
| 2,300,737 | 11/1942 | Willis | 273/148 R X |
| 3,427,027 | 2/1969 | Kenyon | D21/26 X |
| 3,810,628 | 5/1974 | Vigan | 273/142 HA |
| 4,149,728 | 4/1979 | Thompson | 273/274 |

FOREIGN PATENT DOCUMENTS

| | | | |
|---|---|---|---|
| 1532009 | 5/1968 | France | 273/274 |
| 1051062 | 12/1966 | United Kingdom | 273/274 |

*Primary Examiner*—Robert A. Hafer
*Assistant Examiner*—Arnold W. Kramer
*Attorney, Agent, or Firm*—John R. Moses

[57] ABSTRACT

A game apparatus utilizes a rotatable wheel in combination with a playing table. Both the table and wheel include indicia from the standard fifty-two card playing deck. In one embodiment, a pair of concentric wheels are utilized with hands arranged on an outer, stationary wheel and individual card indicia arranged on an inner rotatable wheel. The rotatable wheel is divided into four concentric annular areas, which areas are subdivided into alternating 52 space and 13 space configurations. The stationary wheel is subdivided into 13 spaces each of which has indicia therein indicative of a class of playing card hands or an instruction. A second embodiment utilizes a single rotatable wheel with fifty-two segments representing the fifty-two cards of the standard playing card deck in combination with a horizontal play surface which includes fifty-two spaces arranged in rows according to suit and columns according to denomination.

5 Claims, 5 Drawing Figures

GAME APPARATUS

This application is a division of U.S. patent application Ser. No. 184,874, filed Sept. 17, 1980, which is in turn a continuation-in-part of U.S. patent application, Ser. No. 39,555, filed May 16, 1979, now both abandoned.

BACKGROUND OF THE INVENTION

1. Field of the Invention

The instant inention relates to game apparatus, and more particularly, the instant invention relates to game apparatus which utilizes playing card indicia and a rotating wheel.

2. Prior Art and General Considerations

There are numerous patents on game apparatus which utilize rotating wheels and playing card type indicia. For example, U.S. Pat. Nos. 1,670,692; 1,892,664; Des. 90,553; 1,578,412; 3,810,628; 2,300,737 and 3,941,389. While each of these patents discloses various arrangements of playing card indicia on and disposed with respect to spinning wheels, none, to the instant inventor's knowledge, have been utilized widely in commercial casinos. This is in part because the playing card indicia and wheels have not been coordinated with playing tables in such a way as to make the devices attractive for casino use. Moreover, the prior art arrangements do not coordinate their various elements in a manner which resembles the card game of "poker".

In view of the aforementioned considerations, there is need for an improvement in game apparatus which utilizes in combination wheels and card indicia.

SUMMARY OF THE INVENTION

In view of the aforementioned considerations, the instant invention contemplates apparatus for playing a game of chance wherein the apparatus comprises in combination a rotatably mounted wheel and an adjacent playing board.

In accordance with a preferred embodiment of the instant invention the rotatable wheel is divided into four concentric, annular areas, which areas are subdivided into alternating fifty-two-space and thirteen-space configurations. A fixed surface is disposed adjacent to the rotatable wheel and this fixed surface has a display area which is visible around the periphery of the rotatable wheel, which display area is subdivided into thirteen spaces, each space having indicia therein indicative of a class of playing card hands or an instruction. The playing board includes at least two rows of spaces wherein each space is associated with a respective one of the thirteen denominations of a standard playing card deck.

DETAILED DESCRIPTION OF THE PREFERRED EMBODIMENTS

Figure 1:
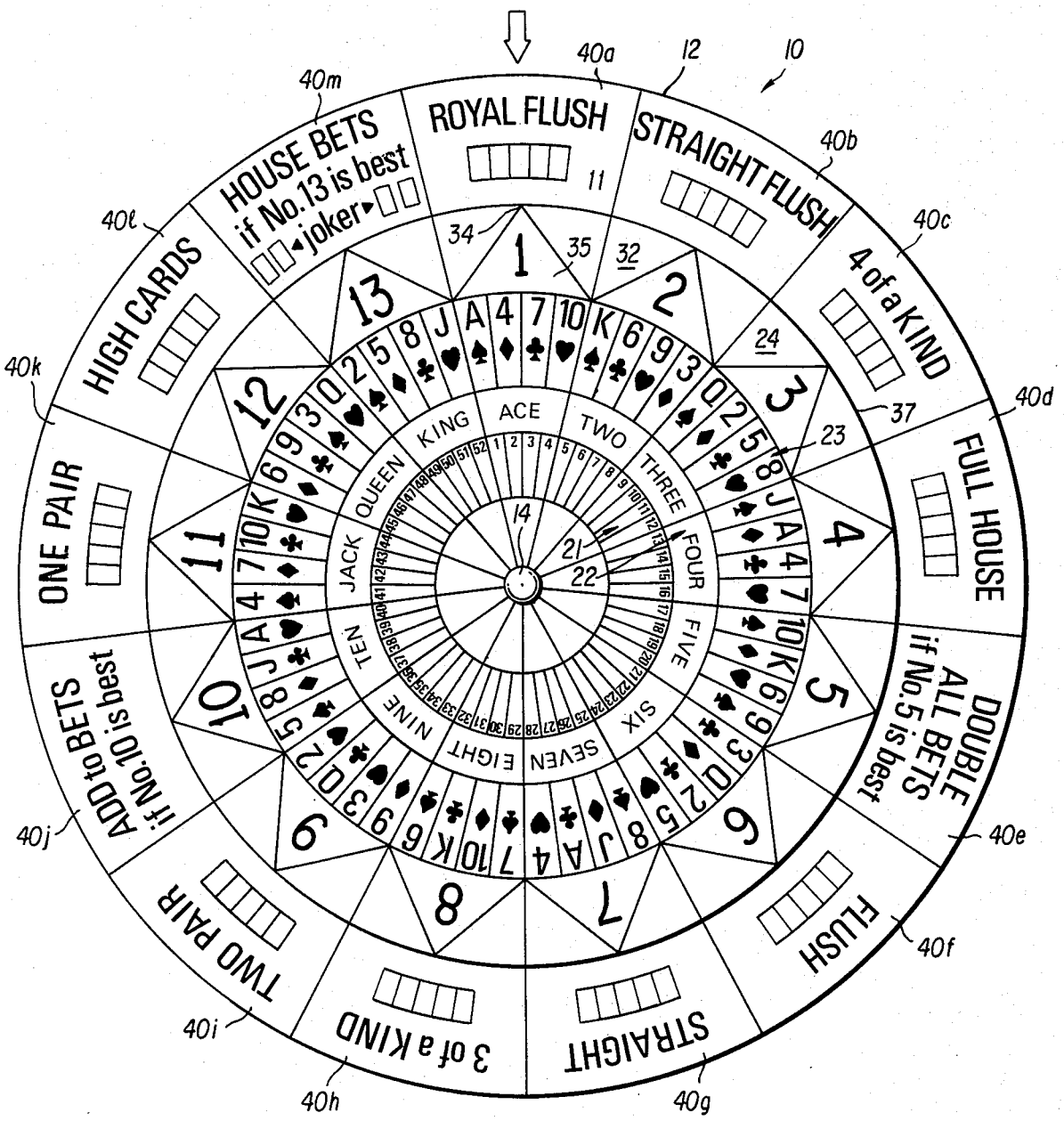
FIG. 1 is a front view of a card wheel in accordance with the instant invention showing a rotatale wheel surrounded by a stationary wheel.
Figure 2:
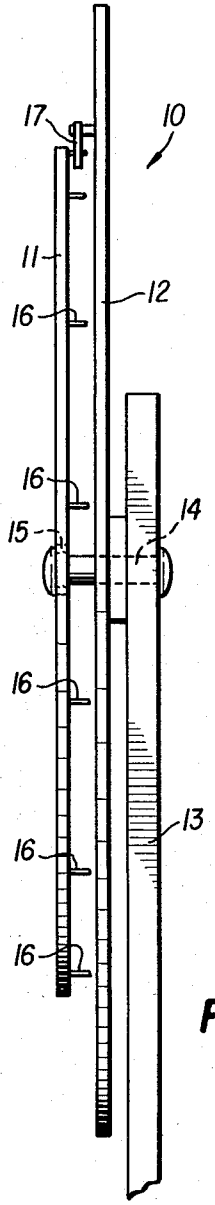
FIG. 2 is a side view of the card wheel of FIG. 1 showing a mounting arrangement for the card wheel.

Referring now to FIGS. 1 and 2, there is shown a card wheel, designated generally by the numeral 10, which includes a rotatable front wheel 11 and a stationary back wheel 12. As is seen in FIG. 2, the wheels 11 and 12 are mounted on a vertical support 13. Concentric with an axle 14, the wheel 11 has low-friction bearings of a known type 15 which enable it to spin freely on the axle 14 while the wheel 12 is rigidly secured to the support 13. A plurality of stops 16 in the form of rods, pins or the like project rearwardly from the rotatable wheel 11 and intersect a flexible tang 17 which eventually stops rotation of the wheel 11 when rotational inertia of the wheel 11 is insufficient to bend the tang 17 so as to clear the stops 16. Accordingly, when one rotates the wheel 11 manually, the rotational position of the wheel 11 with respect to the wheel 12 when the wheel 11 stops is determined only by chance. When utilizing thi apparatus to play the game in which the angular position of the wheel determines the outcome of the game, players rely on guesses which are registered on the board 20 of FIG. 3.

Referring now specifically to FIG. 1, it is seen that the inner rotatable wheel 11 is divided into four annular areas 21, 22, 23 and 24 which are concentered about the axle 14. The first annular area 21 is divided by radii 25 into 52 consecutively numbered spaces. The second annular area 22 is divided into 13 spaces which are identified by the denominations of a standard fifty-two card playing deck.

For the purposes of this application, the denominations of the standard fifty-two playing card deck include the following indicia: "two", "three", "four", "five", "six", "seven", "eight", "nine", "ten", "jack", "queen", "king" and "ace". The annular area 23 is divided by fifty-two radii 28 into spaces 30 each of which is identified with a single card of the standard fifty-two-card playing deck. The denominators are in no special order. The fourth area 24 which surrounds the area 23 is divided into thirteen spaces 32 defined by extensions of the radii 25. Each space 32 has one of the numbers 1 through 13 therein and includes some type of pointer such as the apex 34 of a triangle 35 therein. The apex 34 of the triangle 35 deines the periphery 37 of the wheel 11 which rotates relative to the fixes wheel 12.

The fixed wheel 12 is also divided into thirteen spaces 40, each of which includes a particular poker hand or an instruction as is illustrated in FIG. 1.

Figure 3:
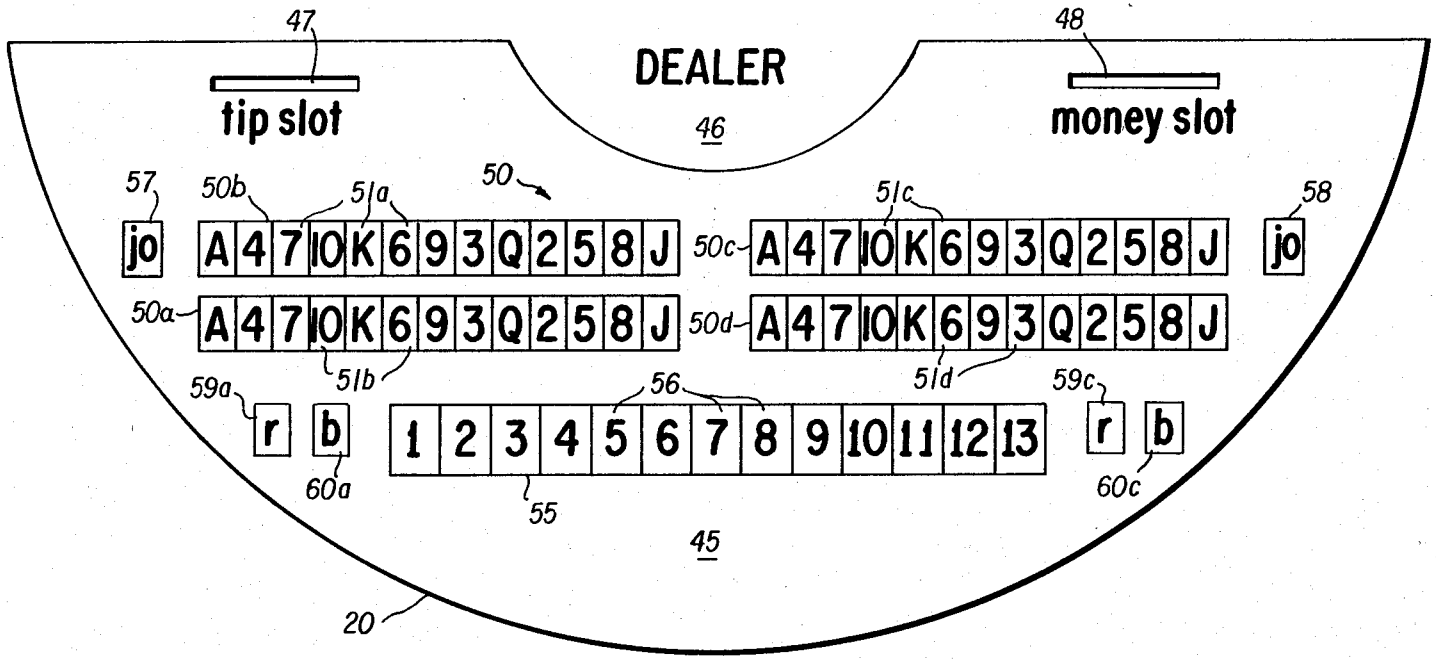
FIG. 3 is a top view of the playing surface for a table utilized with the card wheel of FIGS. 1 and 2.

Referring now to FIG. 3, there is shown the top of the playing table 20 which has a playing area 45 with indicia arranged in a particular fashion thereon. The playing area 45 includes a circular cutout 46 for the dealer, a tip slot 47 which extends therethrough and a money slot 48 which also extends therethrough. Arranged in rows 50*a*, 50*b*, 50*c* and 50*d* are spaces 51*a*, 51*b*, 51*c*, and 51*d*. The thirteen spaces represent the thirteen denominations of cards in the standard fifty-two-card playing deck. In addition, there is a row 55 of thirteen spaces 56 each including one of the numbers from one through thirteen in numerical order. Finally, there are spaces 57 and 58 which have indicia indicating that the spaces correspond to "jokers" and spaces 59*a*, 60*a*, 59*c* and 60*c* which have the letters "R" and "B" therein which correspond to red and black cards or hearts and diamonds, and spades and clubs, respectively. When playing the game, the players compete against the dealer and place chips in various spaces in order to bet on where the rotatale wheel 11 will stop with respect to the stationary wheel 12.

Figure 4:
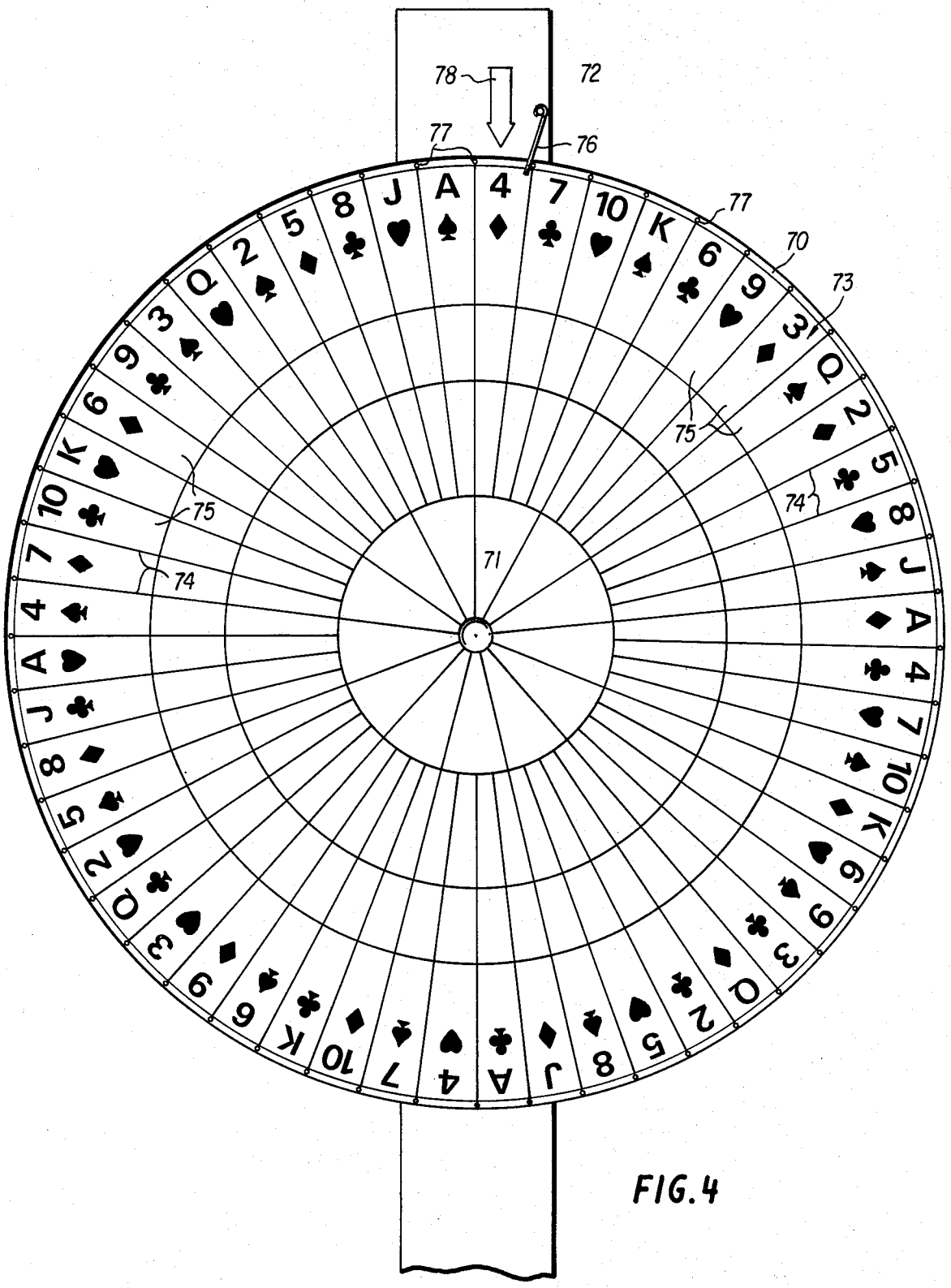
FIG. 4 is a front view of a wheel in accordance with a second embodiment of the instant invention.
Figure 5:
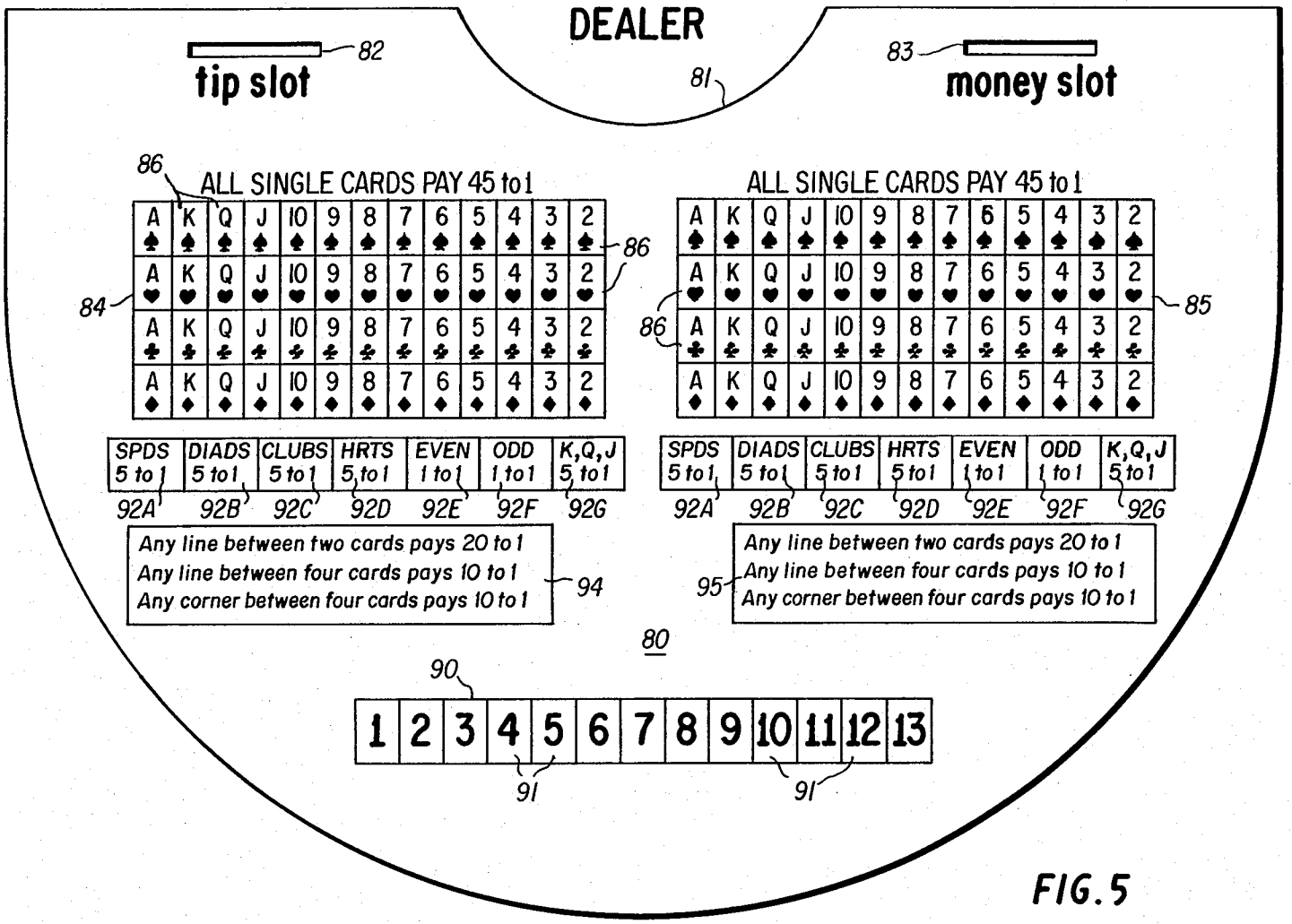
FIG. 5 is a top view of the playing surface of a table utilized with the wheel of FIG. 4.

Referring now to the embodiment of FIGS. 4 and 5, a rotatable wheel 70 is mounted to a fixed support 72 by an axle 71. The rotatable wheel 70 has a peripheral, annular area 73 which is divided by radii 74 into fifty-two sectors 75. Each sector 75 represents a single card of the standard fifty-two-card playing deck and has indicia in the form of suits and denominations to so designate the space. A conventional friction stop 76 engages pins 77 around the periphery of the wheel 70 in order to eventually stop rotation of the wheel in alignment with an indicator 78 which selects a single segment 75.

Disposed in front of the rotatable wheel 70 is a table having a playing area 80 which includes a space 81 for a dealer, a tip slot 82 and a money slot 83. On the playing area 80 are two arrays 84 and 85 of fifty-two spaces 86. Each of the spaces 86 has indicia therein which identifies it with a particular playing card of the standard fifty-two-card playing deck. The indicia are arranged in rows wherein each row is of the same suit and in columns wherein each column has the same denominator in descending order of value from left to right. Accordingly, a player has a convenient frame of reference so that the desired card can be readily selected.

The playing surface 80 also includes a row 90 of thirteen spaces 91 each of which includes one number in increasing magnitude from one to thirteen.

The following odds information is included on the playing surface 80 in the spaces **92*a*–92*g***:

**92*a***—spades 5 to 2
**92*b***—diamonds 5 to 2
**92*c***—clubs 5 to 2
**92*d***—hearts 5 to 2
**92*e***—even numbers 1 to 1
**92*f***—odd numbers 1 to 1
**92*g***—any k.q.j. 5 to 2.

In addition, there are informational boxes 94 and 95 each of which include the following recitations:

"Any line between two cards pays 20 to 1."
"Any line below four cards pays 10 to 1,"
"Any corner between four cards pays 10 to 1."

UTILIZATION OF THE EMBODIMENT OF FIGS. 1, 2 AND 3

The apparatus of FIGS 1, 2 and 3 can be used to play several games. A preferred game is "poker" wherein the players choose a number in one of the spaces 56 on the table 20 with the exception of the numbers five, ten, and thirteen which are designated on the stationary wheel 12 by spaces **40*e*, 40*j* and 40*m*. The number "five" is designated for a double bet in order to give the players a chance to win a double pot; the number "ten" is somewhat similar to "five"; however, every player will add an equal bet to his first bet and whoever has the best hand on the next spin of the wheel 11** wins all with the exception of the house cut. With the number "thirteen", if and when it is the best hand, the house will add a bet until some player wins the pot.

Another game which may be played with the apparatus of FIGS. 1–3 is "select". In "select", the players select a card from the fifty-two cards shown in rows **50*a*, 50*b*, 50*c* and 50*d*, and if the indicator is aligned with this card when the wheel 11 stops, the player wins with odds of 40 to 1. If the indicator in not aligned with this card, then the player loses. While it is preferred that the card indicia of area 23 be utilized, the numerical indica in area 21** can be utilized just as well, at the pleasure of the operator or players.

Another game which can be played utilizing the apparatus of FIGS. 1–3 is "high card". In this game, the operator is identified as the "House" and all players challenge the "House". The operator selects the number "eight" and all players have to beat the "eight" or they lose, i.e., they will have to get a "nine," "ten," "jack," "queen," "king" or "ace." If the rotatable wheel 11 aligns any other number with the indicator, then the "House" wins. This game can be played when there are but a few people available to play "poker".

It can be seen that the particular game apparatus disclosed by FIGS. 1–3 can be seen for various games and thus can generate a great deal of excitement and discussion as to "What game will be played next?". In addition to the disclosed games, games such as "Red and Black" can be played.

UTILIZATION OF THE GAME APPARATUS OF FIGS. 4 AND 5

In playing this game, a chip or coin is placed on one of the cards 86 on the playing surface 80 of FIG. 5 and the wheel 70 spun. When the wheel 70 stops, payout occurs according to the rules set forth in the boxes 92A–92G, 94 or 95. The coin or chip may also be placed on a line between two cards, on a corner between four cards or on a line below four cards, in which case the rules of spaces 94 and 95 apply.

The foregoing embodiments and examples are merely illustrative of the invention which is to be limited only by the following claims:

What is claimed:

1. Apparatus for playing a game of chance, the apparatus comprising in combination:

a rotatable wheel, the wheel including:

a display surface divided into first, second, third and fourth concentric, annular areas, wherein the first area is innermost of the four concentric areas and is divided by fifty-two radial lines into fifty-two sections consecutively numbered by numerals 1 to 52;

the second area surrounds the first area and is divided by thirteen radial lines into thirteen sections marked with indicia identifying each section consecutively with a single respective denomination of the thirteen denominations of a standard fifty-two card playing deck;

the third area being divided by fifty-two radial lines into separate sections each of which is identified by indicia specifying one respective playing card in a standard deck of fifty-two playing cards; and the fourth area surrounding the third area and being divided by thirteen radial lines into thirteen spaces consecutively identified by numerals one through thirteen;

means for mounting the wheel for rotation about an axis, and means for stopping rotation of the wheel; and a fixed surface disposed adjacent to the wheel and having a display area visible around the periphery of the wheel, the display area being divided into thirteen spaces, each space having indicia therein indicative of a class of playing card hands or an instruction.

2. The apparatus of claim 1 further comprising in combination a playing board for use in betting in conjunction with the wheel and fixed surface wherein the playing board includes at least two rows of spaces wherein each space is associated with a respective one of the thirteen denominations of a standard playing card deck.

3. The apparatus of claim 2 wherein there are separate spaces identified with a "joker" and with "red" and "black" cards.

4. The apparatus of claim 2 or 3 wherein there is further included a separate row of spaces each space of which includes a respective digit from one to thirteen.

5. The apparatus of claim 2 or 3 wherein there are four rows of spaces wherein each space of each row is associated with a respective one of the thirteen denominations of a standard playing card deck and wherein there is a separate row of spaces, each space of which includes a respective digit from one to thirteen.

* * * * *